US005421543A

United States Patent [19]

Rossman et al.

[11] Patent Number: 5,421,543

[45] Date of Patent: Jun. 6, 1995

[54] ADJUSTABLE WRIST REST SUPPORT AND METHOD

[75] Inventors: Jon R. Rossman, Chelmsford; Bryan R. Hotaling, Arlington, both of Mass.

[73] Assignee: Curtis Manufacturing Company, Inc., Jaffrey, N.H.

[21] Appl. No.: 143,860

[22] Filed: Oct. 27, 1993

[51] Int. Cl.[6] ..... B43L 15/00

[52] U.S. Cl. ..... 248/118.3; 248/188.2; 248/918

[58] Field of Search ..... 248/118.3, 118, 118.1, 248/918, 188.2; 297/411.36

[56] References Cited

U.S. PATENT DOCUMENTS

| | | | |
|---|---|---|---|
| 1,277,169 | 8/1918 | Anderson . | |
| 1,801,669 | 4/1931 | Hintz et al. . | |
| 2,544,822 | 3/1951 | Brown | 248/188.2 |
| 2,950,890 | 8/1960 | Hough, Jr. . | |
| 4,005,840 | 2/1977 | Ratkovich . | |
| 4,545,554 | 10/1985 | Latino et al. . | |
| 4,688,862 | 8/1987 | Fowler et al. . | |
| 4,913,390 | 4/1990 | Berke . | |
| 4,973,176 | 11/1990 | Dietrich . | |
| 5,058,840 | 10/1991 | Moss et al. . | |
| 5,108,057 | 4/1992 | Dandy, III et al. . | |
| 5,158,256 | 10/1992 | Gross | 248/118.3 |
| 5,183,230 | 2/1993 | Walker et al. . | |
| 5,242,139 | 9/1993 | Aldrich . | |

FOREIGN PATENT DOCUMENTS

| | | | |
|---|---|---|---|
| 1913287 | 8/1970 | Germany . | |
| 2203265 | 8/1973 | Germany . | |
| 2836655 | 10/1979 | Germany . | |
| 2910855 | 10/1980 | Germany . | |
| 16446 | of 1896 | United Kingdom | 248/118.3 |

*Primary Examiner*—Blair M. Johnson
*Attorney, Agent, or Firm*—Richard P. Crowley

[57] ABSTRACT

An adjustable wrist rest support for the wrist of a user engaged in repetitive motions of the fingers and hands, which wrist rest support comprises a support section having a top surface area with a shape to provide support to the wrist of a user, a base section, and a height adjusting platform therebetween snap-fitted together to provide for the selected slidable adjustment of the vertical height of the support section by the user relative to the base section to place the support section in a selected position for use in front of a computer keyboard on a work surface. The top support section has a wrist-cushioning sheet material placed over the top surface area and secured with inner reinforcing ribs, the material optionally having antistatic properties and connected to a metal clip, wire and ground. The height adjusting platform includes a handle for slidable lateral movement by the user to adjust the vertical height of the support section from the base section and has corrugation friction-engaging means on its lower surface that retains the platform in its vertical height position when placed in contact with the corrugated surface on the top section of the base.

23 Claims, 4 Drawing Sheets

ADJUSTABLE WRIST REST SUPPORT AND METHOD

BACKGROUND OF THE INVENTION

There are a wide variety of wrist rest supports known in the art for supporting and protecting the wrists of a user before a work station on a work surface. Generally, the purpose of the wrist rest support is to minimize injury or damage to the unsupported wrist of the operator, when the wrist of the user or operator is engaged in repetitive motions of the hand and fingers for long periods of time, which may, for example, lead to a widely recognized condition known as Carpal Tunnel Syndrome.

It is desired to provide for a new and improved wrist rest support which is simple to manufacture, simple to use, is inexpensive and provides for easy replacement of the wrist-cushioning sheet material employed with the support and which support may be wholly integrally molded except for the cushioned sheet material, and importantly, which wrist rest support may be adjustable in vertical height by the user to accommodate the user.

SUMMARY OF THE INVENTION

The present invention relates to an adjustable wrist rest support for use with a work station on a work surface, wherein the wrist of a user is engaged in a repetitive motion of the hands and fingers. In particular, the invention concerns an adjustable wrist rest support, whereby the vertical height of the wrist rest support may be adjusted by the user to accommodate the comfort position of the user.

The invention comprises an adjustable wrist rest support for the wrist of the user to be engaged in repetitive motions of the fingers and hand, which wrist rest support comprises a support section to provide support to the wrist of the user, and particularly having a top and bottom surface, one and the other end, sides and a top surface having a surface area and a shape such as an ellipsoidal shape, or other shape, to provide support for the wrist of a user.

The wrist rest support also includes a base section positioned beneath the support section and includes a height adjustable means to provide for the selected, slidable adjustment of the vertical height of the support section by the user relative to the base section to place the support section of the adjustable wrist rest support in a selected position for use by a user.

The adjustable wrist rest support is easily manufactured and integrally molded and comprises three separate parts which are snapped and fitted together, which includes the support section, a base section and a height adjustable means between the support and base section, and which then includes a wrist-cushioning sheet material adapted to be wrapped about the surface area of the support section to provide support to the wrist of the user and which wrist cushioning sheet material is typically flexible and composed of a vinyl foam or foam-type sheet materials which is secured at opposite edges between the base section and the support section and which extends substantially between the one and other ends of the support section, and which permits easy replacement by the user. Generally, the wrist-cushioning sheet material may also be adapted to have antistatic properties, that is, to contain carbon black particles or antistatic additives or wires or otherwise be treated to remove antistatic charges from the sheet material in use, and to provide for an electrical connection between the antistatic flexible sheet material on the wrist rest support to a wire which may place the antistatic sheet material in electrical contact with ground. In one embodiment, the support section may include an open section on the bottom surface thereon and a pair of rib elements, which elements are adapted to be inserted within the open section to retain the outer edges of the sheet material wrapped around the rib sections in position.

The support section of the wrist rest support is adjustable in vertical height by slidable adjustment, typically by the use by a user of an outwardly extending handle extending between the support and base section and subject to slidable lateral movement by the user in front of the work station on the work surface, so that the vertical height of the support section of the base section is adjusted. Generally, the top surface of the base section has an indentation therein to receive the handle and to permit movement from one to the other side of the indentation by the handle to provide for an adjustment from zero to the desired height, typically 2 to 3 inches. The vertical height adjusting of the support section relative to the base section may be accomplished in one embodiment by a platform adapted for slidable movement on the top surface of the base section, and which platform contains a pair of generally upright opposing sidewalls on the platform, a plurality of generally aligned, spaced-apart slots placed at angles in the sidewalls, and a handle secured to and extending from the platform and typically to one side and outwardly out from and between the support and base section, so that it may be grasped and laterally moved by the user to slidably move the platform on the top surface of the base section. The platform also includes means to secure detachably the platform to the top surface of the base section by slidable movement and generally comprises a plurality of open receiving spaces, and the base section includes means to receive and secure the platform to the top surface of the base section, and generally includes a plurality of outwardly extending tab sections and a support section that includes a plurality of tabs, which are inserted in the receiving means of the platform so that the platform is secured for slidable movement by ridges on the top surface of the base section.

Optionally and preferably, the wrist rest support also includes a friction-engaging means, such as a plurality of corrugations at each end of the top surface of the base section, and optionally also on the bottom section of the platform at each end, to engage and prevent the further downward movement of the wrist rest support after the selected vertical height adjustment of the support section, and yet which friction-engaging means may be easily overcome by the user employed by laterally moving the extended handle. Generally, the sidewalls extending upward from the platform have a plurality of angled slots, which have an angle extending between 30–60 degrees to the horizontal, and which has corrugations on the bottom surface of the support section placed for slidable movement as the platform is slid along the top surface of the base section so that as the bottom surface of the platform is moved along the top surface of the base section, the support section, with tabs extending in the angled slots and resting on the top surface of the platform, is moved vertically upward to the desired height by the user.

In operation, the wrist rest support of the invention is placed in front of a work station such as a computer keyboard or used with a mouse on a work surface such as a desk or table top and then the user slidably adjusts the vertical height of the support section above the base section to a selected user height position, generally by the user slidably moving an outwardly extended handle secured to the platform and the platform sliding on top of the top surface of the base section to a desired height. The adjustable wrist rest support of the invention is also designed so that the height adjusting means, that is the slidable platform with the sidewalls, angular slots and such, may be removed between the support section and the base section, and the support section and base section merely snap-fit together in a fixed position.

The invention will be described for the purposes of illustration only in connection with certain embodiments; however, it is recognized that by those persons skilled in the art various modifications, changes, additions and improvements may be made to the illustrated embodiments all falling within the spirit and scope of the invention.

DESCRIPTION OF THE EMBODIMENTS

Figure 1:
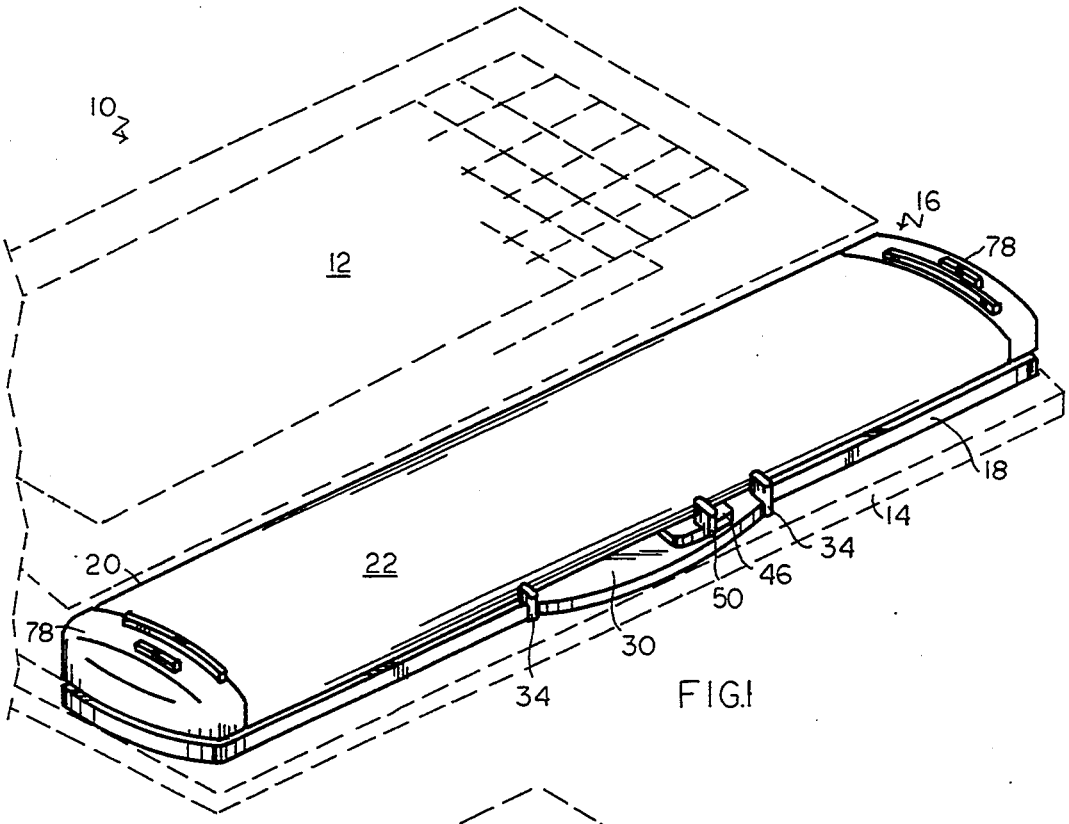
FIG. 1 is a perspective view from above of the adjustable wrist rest support of the invention in a low height adjustable position with a desk top and work station indicated in broken lines.

With reference to the drawings, there is shown an adjustable wrist rest support system which includes a work station 10 comprising a keyboard 12 on a work surface such as a desk top 14 and wherein the wrist rest support of the invention 16 is placed in front of the keyboard 12. The wrist rest support 16 comprises an elongated base section 18 having a flat top surface with a plurality of parallel corrugations at either end and a support section with an ellipsoidal top area 20 with a vinyl foam, wrist-cushioning, antistatic particle-containing sheet material 22 secured over the top surface area 20. The base section has upwardly extended lug elements 24 and out of the support section 20 has cylindrical lug-receiving spaces 54 so that the base section 18 and the support section 20 may be placed together in a snap-fit, friction-engaging fixed position.

The base section 18 contains an outwardly-extending indentation 30 having open side tabs 34 which define the handle section space 30, the base section 18 includes rubber friction-engaging feet 32 on its lower surface to prevent the lateral movement of the wrist rest support on the desk top 14. The rubber friction-engaging feet 32 are illustrated more fully in FIG. 6. The support section 20 includes slightly upwardly raised end sections 78 at each end, adapted to prevent lateral movement of a sheet material, such as vinyl foam sheet material, from sliding from the top surface area of the support section, and includes an open section on the bottom surface thereof for the insertion of a rib enforcing tab 62, the reinforcing rib 62 including a plurality of lug receiving spaces 76 which are adapted to snap into lugs 60 extending outwardly from the bottom section of the support section 20, so as to snap the ribs 62 into place. The ribs are designed to provide for the overlapping of the outer edges of the sheet material 22 and to retain the sheet material in position, thereby enabling a user to easily and rapidly replace the flexible wrist-cushioning sheet material on the top surface 20 of the support section by snapping out the rib elements and replacing the sheet material on top of the surface area and snapping in the rib elements to retain the sheet material in position. The support section 16 also includes a plurality of outwardly-extending tab elements 56 which are designed to fit in angled slots 44 in the height-adjusting means as hereafter described.

Figure 4:
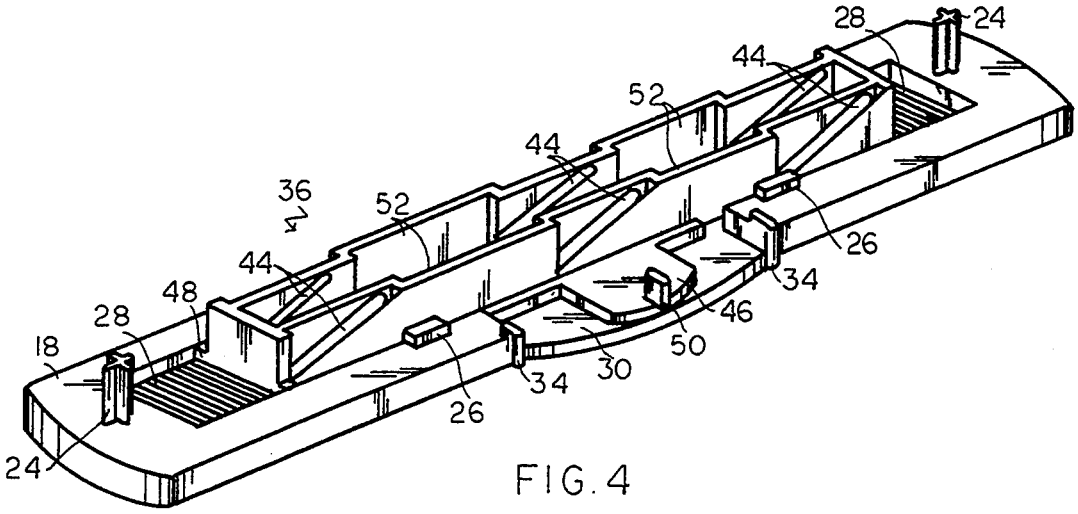
FIG. 4 is a top plan view of the platform on the base section in intermediate height position.

The height adjusting means of the invention as shown more particularly in FIG. 4 comprises a slidable platform-type device 36 which is adapted to be placed between the support section 20 and the base section 18, which comprises a base platform having a plurality of open spaces 42 therein designed to fit within the outwardly extending tabs 26 of the base section 18, so as to permit the platform section 36 to be placed and slidable on the top surface of the base section 18 to be retained in slidable movement by outward ridges on either side of the tab elements 26 placed over the ridges 48 on either side of the platform 36 to retain and to permit the lateral slidable movement of the bottom of the platform on the top surface of the base section, and yet the tabs 26 adapted to fit within the recessed spaces 42 on the bottom of the ridges of the platform 36 to permit removal and assembly of the platform on the top surface of the base section. The platform also includes a pair of upright, generally vertical opposing sidewalls 52 having a plurality of angled slots 44 in each sidewall in an aligned position, the length and the angle of the slots designed and related to the degree of vertical height adjustment desired. The support section has a plurality of tabs 56 which are adapted to be snap-fitted into each of the angular slots 44 on the platform section 36 and to be slidably and angularly movable therein when the platform is laterally moved in the top surface of the base section 18. The platform 36 includes an outwardly extended handle means 46 and a generally upright tab means 50 for grasping by the user, and which handle means extends through the indentation 30 in the base section. The handle means 46 permits the user to move the platform means 36 on the top surface of the base section means by moving laterally from one side to the other to raise or lower the height of the support section relative to the base section.

Figure 2:
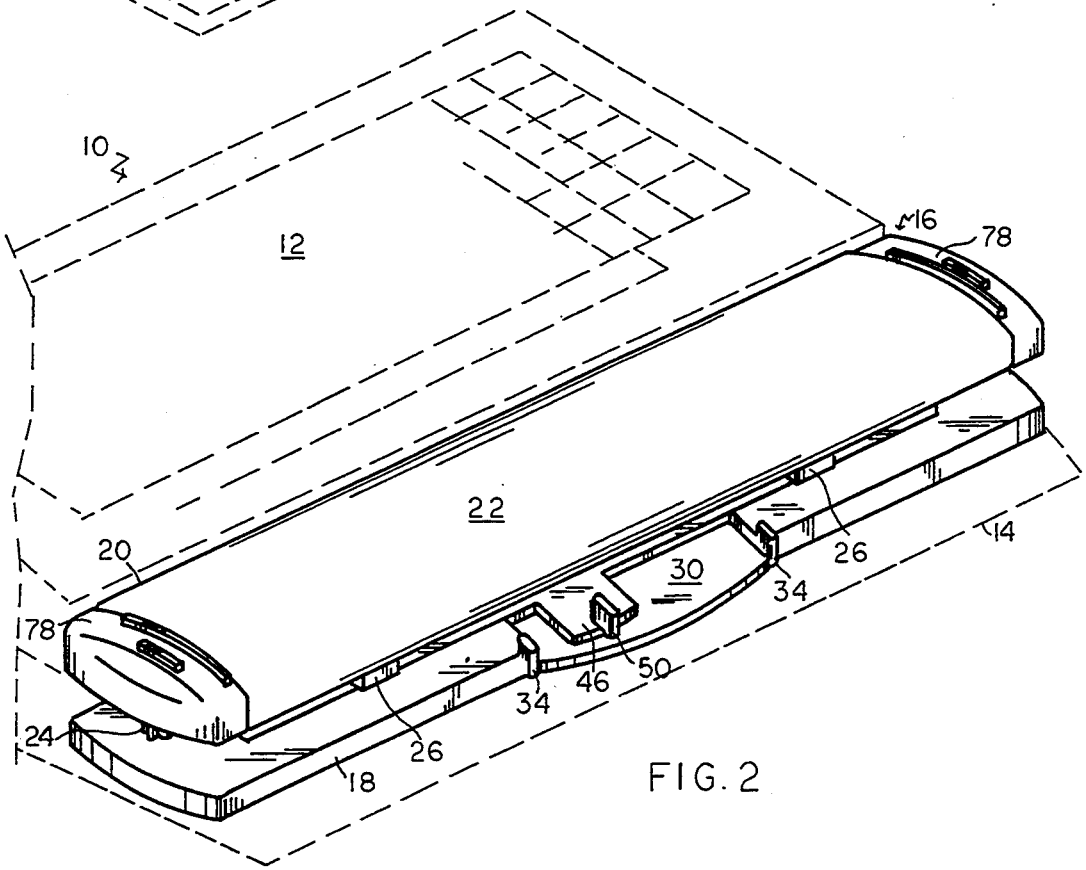
FIG. 2 is a perspective view from above of the adjustable wrist rest support of the invention in a vertical height-adjusted position with a desk top and work station indicated in broken lines.

The wrist rest support system, before a keyboard and on a table top, is shown in a lowered position in FIG. 1, and in FIG. 2 shown in an upwardly raised vertical height adjusting position wherein the lateral handle means 46 and the upwardly extending tab 50 has been moved from right to left by the user to extend the height of the support section 20 with the flexible cushioning material thereon.

Figure 3:
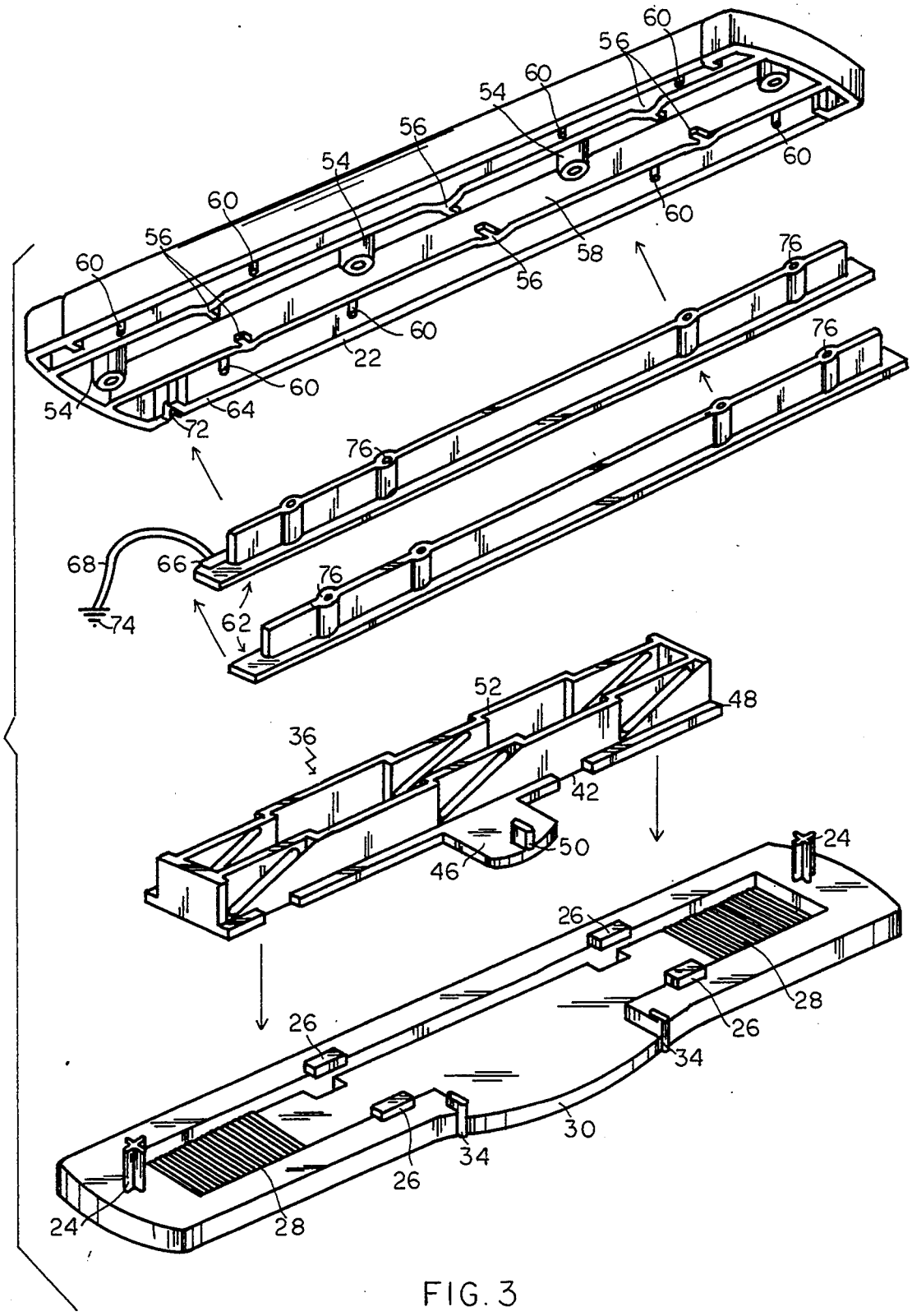
FIG. 3 is a perspective exploded view of the components of the wrist rest support invention.

As shown in FIG. 3, one of the reinforcing ribs 62 has attached thereon a metal spring clip 66 that is connected to the flexible wrist-supporting cushioning sheet material 22, the metal clip having an extending wire 68 having a connector 74 at the one end thereof, which connector may be secured to a ground connection to permit the drain-off of static charges during use of the wrist rest support. A hole 72 is molded into the vertical outward support edge 64 on the top support section to accommodate the ground wire.

Figure 5:
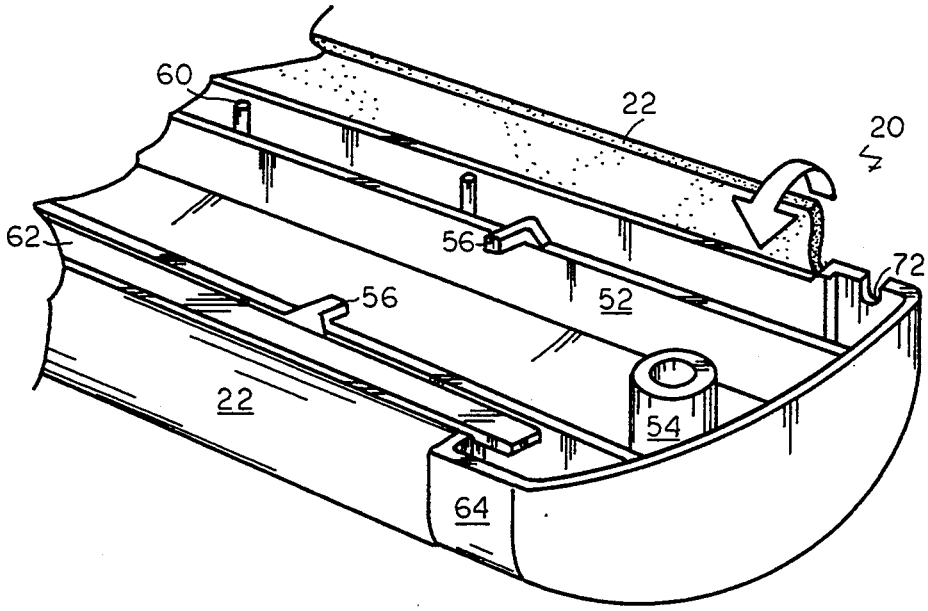
FIG. 5 is a perspective view of the bottom of the support section of the wrist rest support.

The adjustment and fixation of the foam vinyl cushioning sheet material 22 on the support section 20 is illustrated more particularly in FIG. 5, wherein the sheet material 22 is folded over the outer edges 64 of the open bottom of the support section, and then the reinforcing ribs 62 are snapped into position to maintain the sheet material 22 in a detachable, removable, taut position on the top surface area 20.

Figure 6:
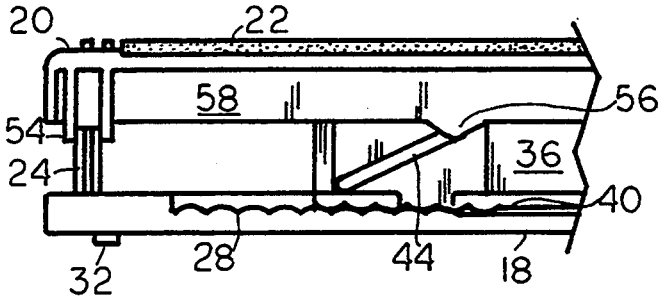
FIG. 6 is an enlarged, fragmentary view of a portion of the wrist rest support section of the invention in a vertical height-adjusting position.

FIG. 6 is in particular a sectional illustration showing one of the tabs 56 of the top section slidably mounted in one of the angular slots 44 in the platform 36, with the platform adjusted for partial raised height on the top surface of the base section 18. The base section includes corrugating means 28 on each end while the lower portion of the lower surface of the platform means also includes friction-engaging means 40, such as corrugation means, so as to permit the support section to be maintained in the selected vertical position by the user, so that the wrist of the user may rest on the support section without downward movement of the support section to the base. However, the handle 46 and upward tab means 50 permits the user to overcome the friction-engaging surfaces on the bottom surface of the platform and the top surface on the base section, to then laterally adjust the height or to raise and lower the height of the top section.

Figure 7:
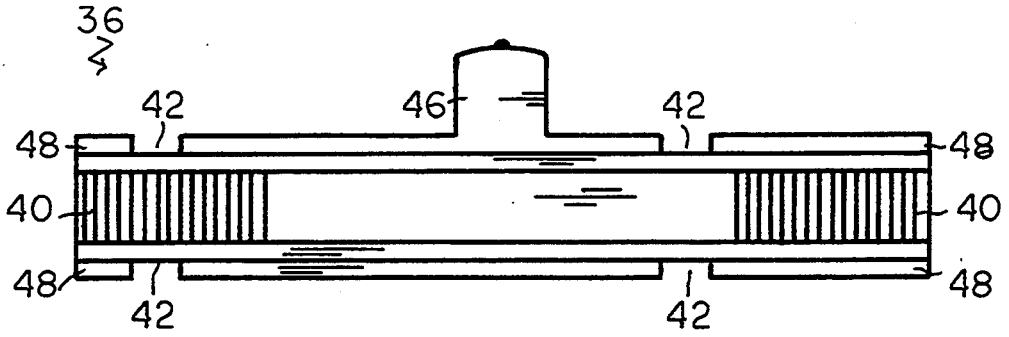
FIG. 7 is a bottom plan view of the platform section of the wrist rest support of the invention.

FIG. 7 illustrates a bottom plan view of the corrugated friction-engaging means 40 on the lower portion of the lower surface of the platform means.

The adjustable wrist rest support section as described and illustrated thus provides that the user may easily and rapidly adjust the selected vertical height of the support section above the base by lateral, slidable movement of the platform through the handle means on the top surface of the base section. The entire wrist rest support section may be easily molded of a hard molded plastic and comprises three integrally molded parts which may be easily assembled, shipped and used, and includes the insertion of the detachable sheet material by the user on the top surface area of the support section, and permits replacement of the sheet material in use and also permits attachment of the sheet material to ground. If desired, the height adjusting means employed may be moved by the user to adjust the base section and the support section used together in a snap-fit, fixed position as a wrist rest support material.

What is claimed is:

1. An adjustable wrist rest support for the wrist of a user engaged in repetitive motions of the fingers and hands, which wrist rest support comprises:

a) a support section having a top and bottom surface, one and other end, front and back sides and a top surface having a surface area and a shape to provide support to the wrist of a user;

b) a base section having one and an other end, front and back sides and a top surface and secured to and positioned beneath the support section;

c) height adjusting means to provide for the slidable adjustment of the vertical height of the support section by the user relative to the base section to place the support section in a selected position for use; and d) handle means outwardly extending from the front side and connected to the height adjusting means and adapted for slidable lateral movement by the user to adjust the vertical height of the support section from the base section.

2. The support of claim 1 which includes a flexible wrist-cushioning sheet material over the surface area of the support section.

3. The support of claim 1 wherein the base section has planar dimensions generally the same as the planar dimensions of the support section.

4. The support of claim 2 wherein the sheet material comprises a foam sheet material placed over the top surface area and between the one and other ends and secured at opposite outer edges between the base section and support section.

5. The support of claim 2 wherein the sheet material has antistatic properties, and the support section includes means to place the antistatic sheet material in electrical contact with ground.

6. The support of claim 1 wherein the support section includes raised end sections at the one and the other end of the support section and which support section includes on the top surface a flexible, wrist-cushioning sheet material extending generally between the raised sections and over the surface area.

7. The support of claim 1 wherein the top surface of the base section has an indentation therein to receive the handle means and to permit movement from one to the other side of the handle means.

8. The support of claim 1 wherein the base section includes a friction-engaging surface means to provide for the retention of the support section in its adjusted vertical height position.

9. The support of claim 8 wherein the friction-engaging surface means includes corrugations at each end of the top surface of the base section.

10. The support of claim 1 which includes a pair of elongated open spaces on either side of the open bottom surface of the support section, and a pair of snap-in, sheet material retaining ribs therein to retain the sheet material in a taut position on the surface area of the support section.

11. The support of claim 1 wherein the height adjusting means includes a slidable platform means between the support section and base section, the platform adapted to be slidably moved by an extended handle means along the top surface of the base section and secured to the support section, with the vertical height of the support section raised from the base section.

12. The support of claim 11 wherein the height adjusting means includes:

a) a platform adapted for slidable movement on the top surface of the base section;

b) a pair of generally upright opposing sidewalls on the platform;

c) a plurality of generally aligned, spaced-apart slots placed at an angle in the side walls;

d) handle means secured to and extending from the platform; and e) means on the platform to secure detachably the platform to the top surface of the base section for slidable movement;

i) wherein the base section includes means to receive and secure the platform to the top surface of the base section; and ii) wherein the support section includes a plurality of tabs for insertion in the receiving means of the platform to permit slidable movement of the platform on the base section by lateral movement of the handle means.

13. The support of claim 11 which includes friction-engaging means at each end of the top surface of the base section to engage and prevent the further movement of the support section after selected vertical height adjustment.

14. The support of claim 11 wherein the platform has a bottom surface with friction-engaging means with the top surface of the base section to secure the platform in a selected height position.

15. The support of claim 11 wherein the means on the platform to receive detachably the platform includes a plurality of spaced-apart, open sections on the platform and the means to receive on the base section includes a plurality of aligned, spaced-apart tabs on the base section to fit within said open sections.

16. The support of claim 11 wherein the angled slots have an angle from the horizontal of between about 30 to 60 degrees.

17. The support of claim 11 wherein the height adjusting means provides for slidable adjustment of the height of the support section up to a height of 0 to about 2½ inches.

18. In combination, a system which comprises a work station on a work surface which includes a keyboard and the adjustable wrist rest support of claim 1 positioned on the work surface in front of the work station and keyboard and adjusted in height to support the wrist of the user for use of the keyboard.

19. The support of claim 1 which includes detachable securing means which comprise a plurality of lugs on the top surface of the base section or the bottom surface of the support section and a plurality of lug-receiving spaces on the other respective base section or support section and aligned with and adapted to receive the lugs therein of the other section in a snap-fitting, friction detachable relationship to secured the support section to the base section and to permit easy detachment of the sections from each other.

20. The support of claim 1 wherein the base section, the support section, height adjusting means and handle means are composed of a hard, molded material in a snap-fitted relationship to form the wrist rest support.

21. The support of claim 1 wherein the base section includes a single, generally centrally positioned, planar, oval, outwardly extending element from the front side of the base section.

22. A method for the use of a wrist rest support with a work station on a work surface, which method comprises:

a) providing a wrist rest support for the wrist of a user engaged in repetitive motions of the fingers and hands, which wrist rest support comprises:
   i) a support section having a top and bottom surface, one and other end, front and back sides and a top surface having a surface area and a shape to provide support to the wrist of a user;
   ii) a base section having one and an other end, front and back sides and a top surface and secured to and positioned beneath the support sections.
   iii) height adjusting means to provide for the slidable adjustment of the vertical height of the support section by the user relative to the base section to place the support section in a selected position for use; and
   iiii) handle means outwardly extending from the front side and connected to the height adjustment means and adapted for slidable lateral movement by the user to adjust the vertical height of the support section form the base section;
b) positioning the wrist rest support in front of a keyboard on a work surface; and
c) slidably adjusting the vertical height of the support section above the base section by slidable lateral movement of the handle means to a selected height position.

23. The method of claim 22 which includes detachably securing a flexible wrist cushioning sheet material over the top surface of the support section and securing ends of the sheet material between the base section and the support section.

* * * * *